US006846202B1

(12) United States Patent
Schmidt et al.

(10) Patent No.: US 6,846,202 B1
(45) Date of Patent: Jan. 25, 2005

(54) ELECTRICAL CONNECTOR ASSEMBLY WITH MOVEABLE CONTACT ELEMENTS

(75) Inventors: Helge Schmidt, Speyer (DE); Reinhard Sander, Pleinfeld (DE)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 10/049,950

(22) PCT Filed: Aug. 18, 2000

(86) PCT No.: PCT/DE00/02842

§ 371 (c)(1),
(2), (4) Date: Jul. 29, 2002

(87) PCT Pub. No.: WO01/15280

PCT Pub. Date: Mar. 1, 2001

(30) Foreign Application Priority Data

Aug. 20, 1999 (DE) ..... 199 39 580

(51) Int. Cl.[7] ..... H01R 24/00; H01R 33/00
(52) U.S. Cl. ..... 439/660; 439/247
(58) Field of Search ..... 439/247, 248, 439/311, 660, 626

(56) References Cited

U.S. PATENT DOCUMENTS

| | | | | |
|---|---|---|---|---|
| 4,501,465 A | | 2/1985 | Hoshino et al. | 439/633 |
| 4,998,887 A | | 3/1991 | Kaufman et al. | 439/78 |
| 5,030,140 A | | 7/1991 | Sugiyama | 439/607 |
| 5,181,855 A | * | 1/1993 | Mosquera et al. | 439/74 |
| 5,219,294 A | | 6/1993 | Marsh et al. | 439/79 |
| 5,277,597 A | * | 1/1994 | Masami et al. | 439/83 |
| 5,295,843 A | | 3/1994 | Davis et al. | 439/108 |
| 5,556,286 A | * | 9/1996 | Ikesugi et al. | 439/74 |
| 5,593,322 A | | 1/1997 | Swamy et al. | 439/660 |
| 5,599,192 A | * | 2/1997 | Olson | 439/65 |
| 5,626,483 A | * | 5/1997 | Naitoh | 439/74 |
| 5,702,255 A | | 12/1997 | Murphy et al. | 439/71 |
| 5,921,787 A | * | 7/1999 | Pope et al. | 439/74 |
| 5,954,544 A | * | 9/1999 | Yang | 439/660 |
| 5,961,347 A | * | 10/1999 | Hsu | 439/570 |
| 5,980,325 A | * | 11/1999 | Horchler | 439/660 |
| 6,045,408 A | * | 4/2000 | Takemasa | 439/660 |
| 6,048,213 A | * | 4/2000 | Lai et al. | 439/74 |
| 6,062,892 A | * | 5/2000 | Meng et al. | 439/357 |
| 6,071,151 A | * | 6/2000 | Igarashi | 439/660 |
| 6,368,121 B1 | * | 4/2002 | Ueno et al. | 439/108 |
| 6,454,610 B1 | * | 9/2002 | Yu | 439/660 |

FOREIGN PATENT DOCUMENTS

| | | |
|---|---|---|
| WO | WO 95/24748 | 9/1995 |
| WO | WO 96/08056 | 3/1996 |

* cited by examiner

*Primary Examiner*—Michael C. Zarroli
(74) *Attorney, Agent, or Firm*—Baker & Daniels

(57) ABSTRACT

An electrical connector containing one or more connector modules, each having at least one contact support and a multiplicity of contact elements connected to the contact support in a non-releasable manner. The contact elements are connected to the contact supports by way of plastic material injection molded around part of the contact elements.

20 Claims, 7 Drawing Sheets

ELECTRICAL CONNECTOR ASSEMBLY WITH MOVEABLE CONTACT ELEMENTS

BACKGROUND OF THE INVENTION

1. The Field of the Invention

The present invention relates to a device according to the generic clause of claim 1, i.e. to an electrical connector comprising a multiplicity of contact elements.

2. Technical Background

Electrical connectors have been known for many years in a multitude of forms.

Due to the continuous increase in complexity and efficiency of electronic systems, there are also ever increasing requirements as to the electrical connections between the system components. In this regard, there is an increasing demand of electrical connectors which on the one hand operate reliably under all circumstances, i.e. also under high mechanical and electrical loads, and which on the other hand have as many contacts as possible while being as small as possible.

There are already various electrical connectors known in which attempts have been made of fulfilling the requirements mentioned.

In this context, the electrical connectors should be mentioned that are used for connecting LCD units to the apparatus controlling the same. To this end, there are usually employed electrical connectors having press-on contacts, with the press-on contacts being realized by a very dense arrangement of conductive elastomer portions in a non-conductive elastomer. The connections to be established via such electrical connectors are of relatively high impedance and moreover necessitate extremely clean conditions.

These problems can be solved at least in part by making use of correspondingly small and multi-position connectors.

BRIEF SUMMARY OF THE INVENTION

Multi-position connectors of miniaturized configuration are known from WO 95/24748 and WO 96/08056. However, connectors of this type are not susceptible of reliable control, both in manufacture and in handling thereof, and the same thus holds analogously for the electrical connections established by such electrical connectors.

It is thus the object of the present invention to provide a multi-position miniaturized connector that is capable of reliably establishing electrical connections of high quality.

According to the invention, this object is met by the features claimed in the characterizing part of claim 1.

The latter provides that the electrical connector contains one or more connector modules, each thereof comprising at least one contact support and a multiplicity of contact elements connected to said contact support and extending along the surface of the same.

Due to the arrangement of the contact elements along the surface of a contact support, they can be reliably arranged and held in predetermined positions without a problem. In addition thereto, when they are contacted with other contact elements, they have to be capable of withstanding no or just minimum mechanical loads. At any rate, possibly occurring mechanical loads do not entail a change of the contact element position or damage of the contact elements. This holds also for the event that the contact elements are of weak mechanical design. The contact elements thus can be made very small and/or have a very dense arrangement.

If, for example, very narrow metal strips are used as contact elements and these are connected to the contact support supporting the same, for example, by having plastics material injection-molded thereto, which is possible without any problem with the claimed construction of the electrical connector, a multi-position miniature connector can be provided by means of which electrical connections of high quality can be reliably established.

Advantageous developments of the invention are indicated in the dependent claims, the following description and the drawing figures.

BRIEF DESCRIPTION OF THE DRAWINGS

In the following, the invention will be described in more detail by way of embodiments with reference to the drawings.

In the drawings.

DETAILED DESCRIPTION OF THE PREFERRED EMBODIMENT

The electrical connectors described hereinafter are circuit board connectors. However, it is to be pointed out already here that there is no restriction thereto. The special features of the electrical connectors described may also be applied to electrical connectors employed for other purposes.

As is usual with pluggable connectors, an electrical connection is established by mating an electrical connector in the form of a plug and an electrical connector in the form of a coupling member.

In the embodiment illustrated, the plug comprises a multiplicity of identical plug modules arranged side by side and/or on top of each other. The same holds for the coupling member. The latter comprises a multiplicity of identical coupling modules arranged side by side and/or on top of each other. However, the invention is not restricted to this. The plug and the coupling member may also contain only one module or a plurality of not identical modules.

Figure 1:
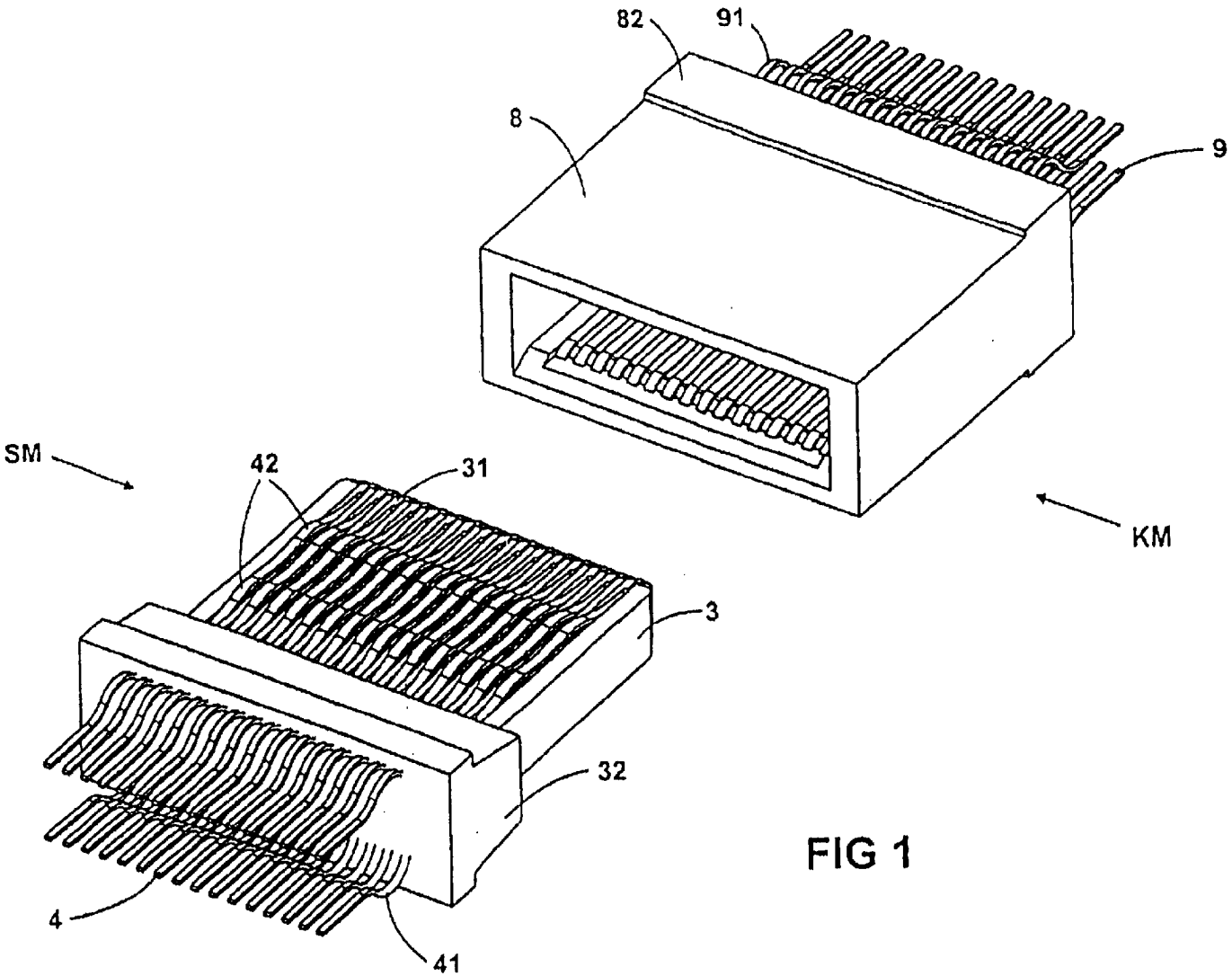
FIG. 1 shows a perspective view of connector modules of the electrical connectors described in more detail hereinafter.

A plug module and a coupling module are shown in a perspective view in FIG. 1. The plug module is designated SM and the coupling module is designated KM. The plug module SM is adapted to be inserted into the coupling module KM.

In the embodiment illustrated, each connector module (each plug module and each coupling module) comprises 32 contact elements. However, the number of contact elements may also be arbitrarily higher or lower.

If a plurality of such plug modules SM is arranged above each other and/or beside each other on a base that is preferably common to all plug modules and if these are enclosed by a common housing, one arrives at the electrical plug described in more detail herein. The front view of such an electrical connector is shown in FIG. 2.

The same holds for the coupling modules KM in corresponding manner. If a plurality of such coupling modules KM is arranged on top of each other and/or side by side on a base that is preferably common to all coupling modules and if these are enclosed by a common housing, one arrives at the electrical coupling member described in more detail herein. The front view of such an electrical connector is shown in FIG. 3.

Figure 2:
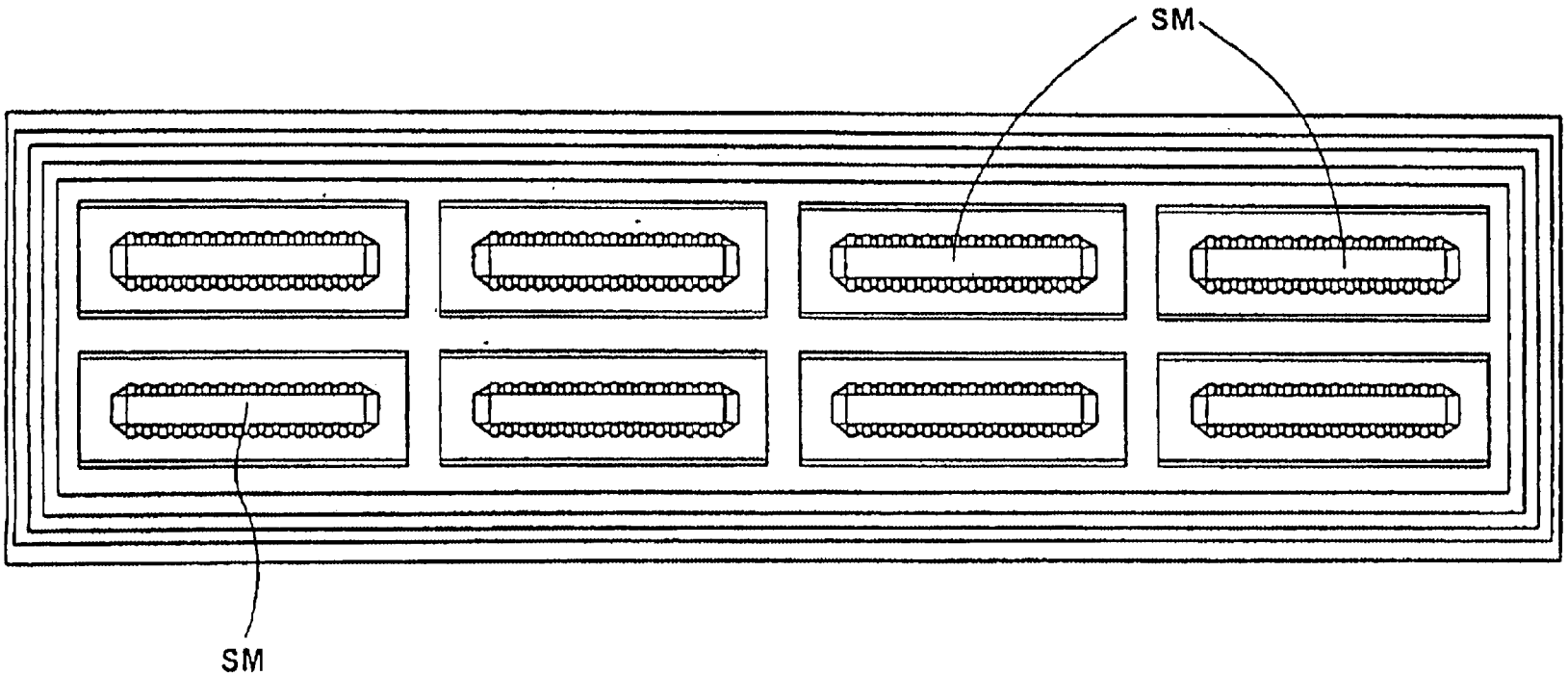
FIG. 2 shows a frontal plan view of a connector plug containing a plurality of plug modules according to FIG. 1.
Figure 3:
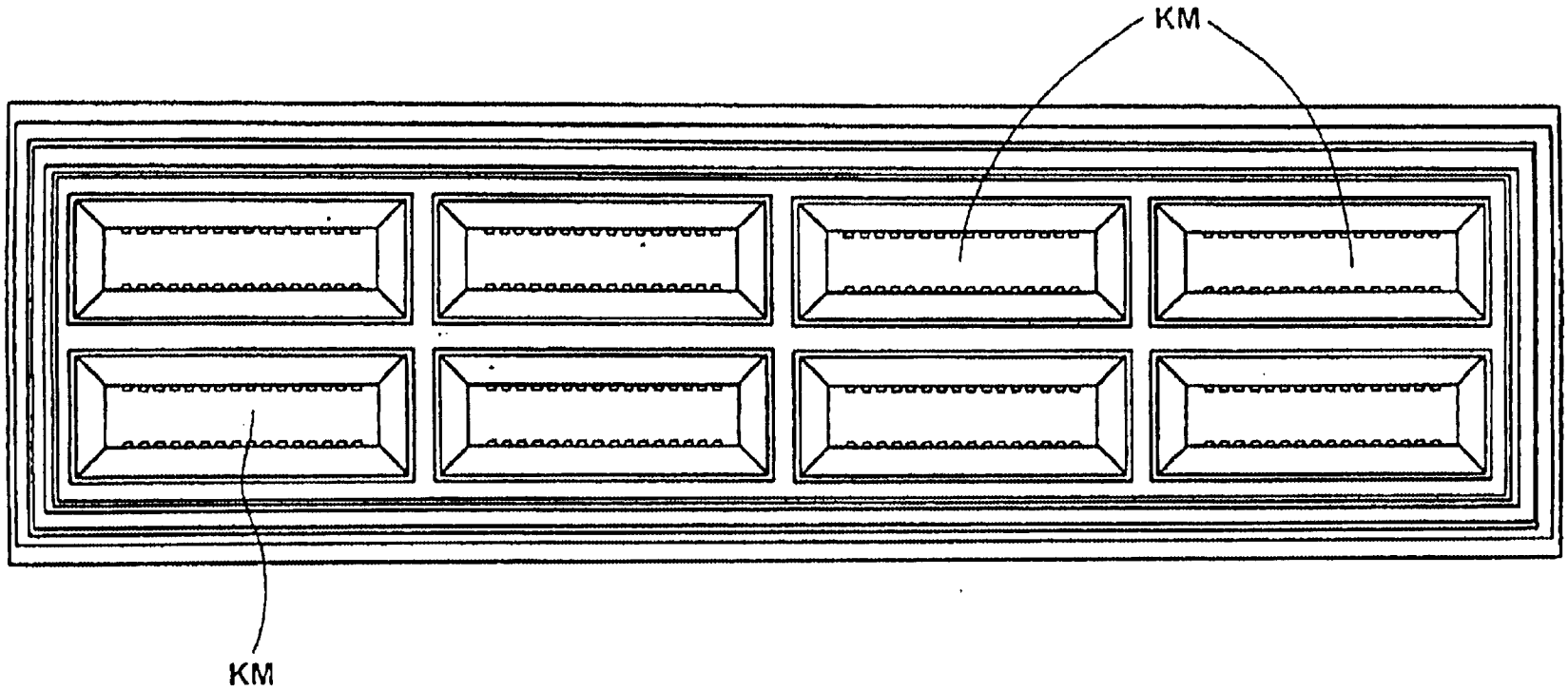
FIG. 3 shows a frontal plan view of a connector coupling member containing a plurality of coupling modules according to FIG. 1.
Figure 4B:
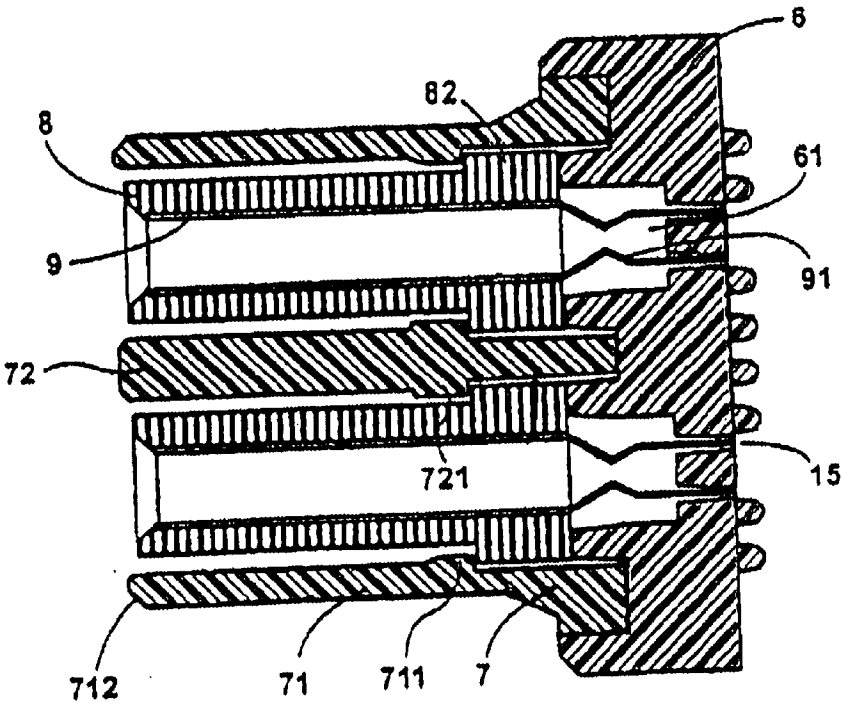
FIG. 4B shows a cross-sectional view of the coupling member according to FIG. 3.
Figure 4A:
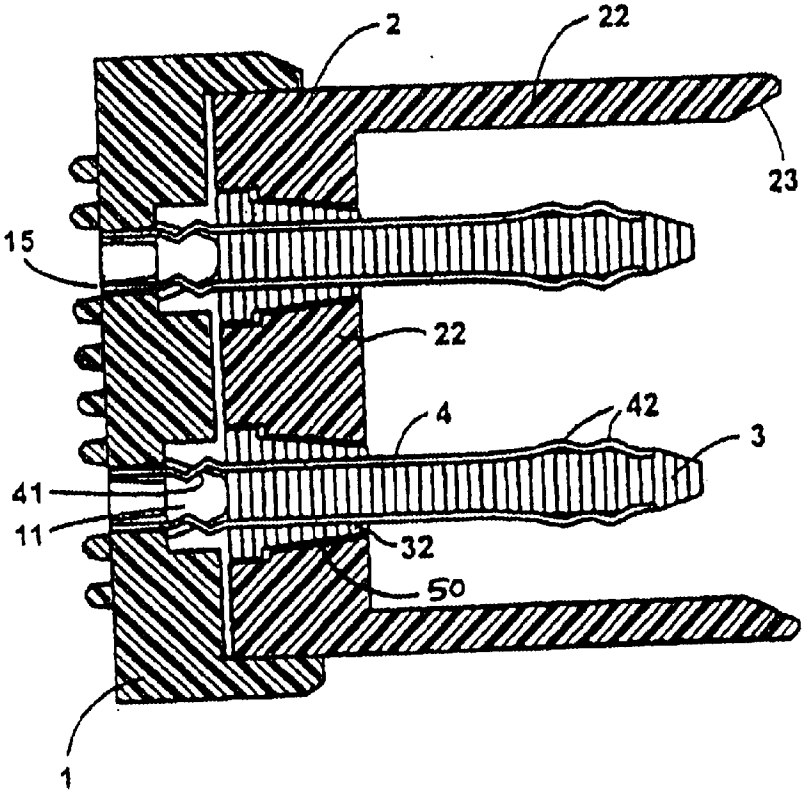
FIG. 4A shows a cross-sectional view of the plug according to FIG. 2.
Figure 4C:
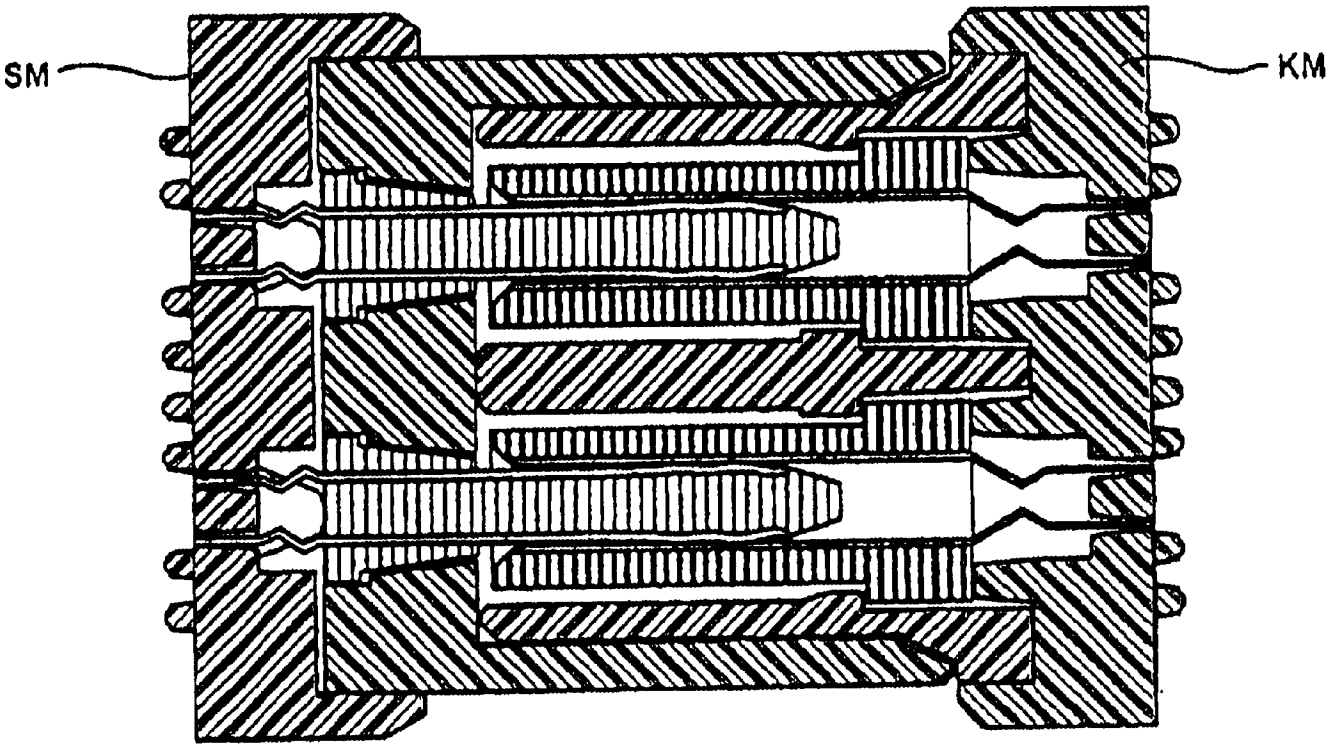
FIG. 4C shows a cross-sectional view of an assembly in which a plug according to FIG. 2 and a coupling member according to FIG. 3 are mated.
Figure 4D:
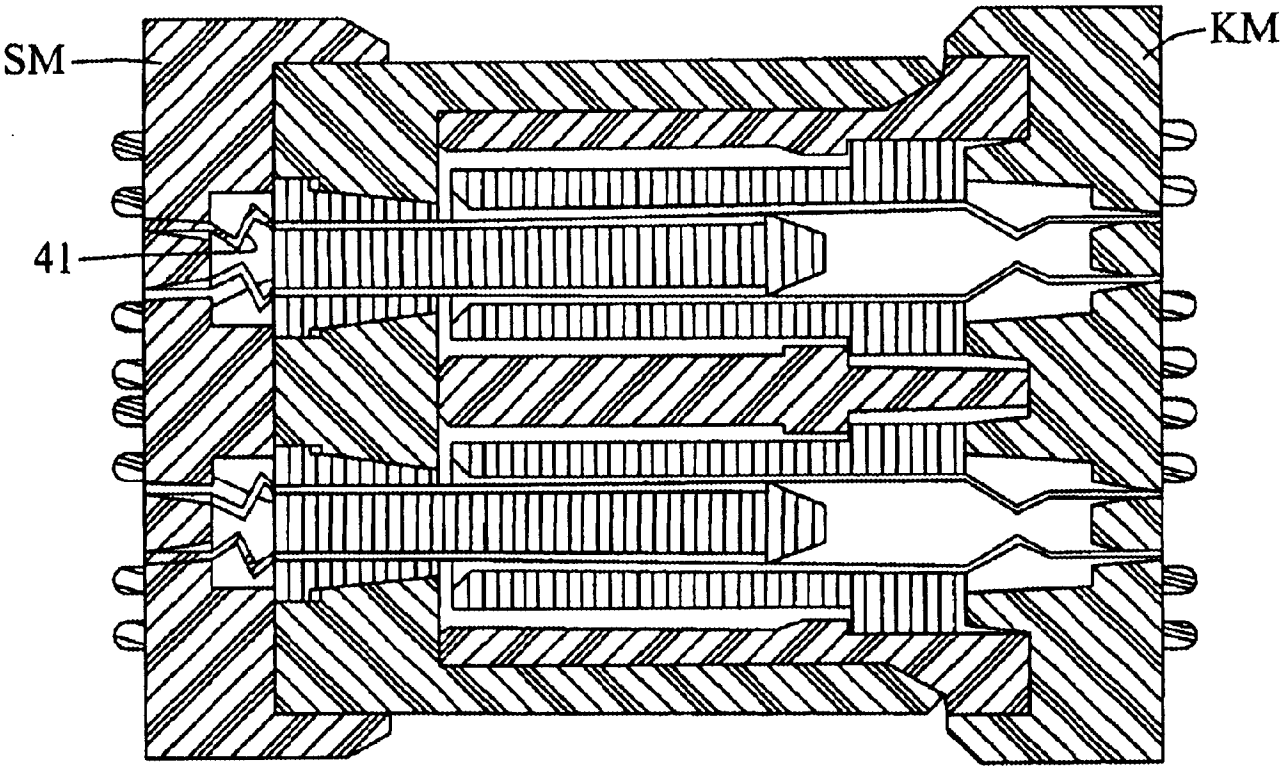
FIG. 4D is a view similar to that of FIG. 4C, showing relative movement in the contact parts adjacent the kinked section.

FIGS. 4A, 4B and 4C illustrate cross-sectional views of the electrical connectors according to FIGS. 2 and 3. To iso be precise, FIG. 4A shows a cross-sectional view of the plug according to FIG. 2, FIG. 4B shows a cross-sectional view of the coupling member according to FIG. 3, and FIG. 4C shows the plug according to FIG. 2 and the coupling member according to FIG. 3 in the mated state.

The plug illustrated in FIG. 4A comprises a base 1 (already mentioned hereinbefore), a housing 2 (also already mentioned) and one or more plug modules SM, with each plug module SM consisting of a contact support 3 and a multiplicity of contact elements 4.

In the embodiment shown, there is provided one single contact support 3 for each plug module SM; each contact support 3 has mounted thereon all contact elements of the respective plug modules. However, the invention is not restricted to this design. Basically, there may be an arbitrary number of contact supports provided for each plug module SM.

As can be seen in particular from FIGS. 1 and 2, the contact elements 4 are arranged on the contact support 3 carrying the same in the form of two mutually opposing contact element rows. Although this is presently deemed to be the optimum arrangement, the invention is not restricted thereto.

In the embodiment shown, the contact elements 4 are constituted by relatively long and relatively narrow metal strips with as high rigidity as possible. In a portion 41 located relatively far to the rear, they have a (preferably multiply) curved or kinked path (e.g. of zig-zag shape). The contact elements 4 of the plug and/or of the coupling member in addition thereto have in the front portion (the portion provided for establishing contact with the contact elements of the coupling member and the plug, respectively) at least one, but preferably two or more bulges or equivalent designs of the contact elements. In the embodiment shown, it is the contact elements 4 of the plug that are provided with these bulges; these bulges bear the reference numeral 42.

The bent or kinked portion 41 of the contact elements 4 renders possible that the parts of the contact elements located on either side, i.e. both sides of said portion are movable relative to each other. (FIG. 4B). In the properly assembled condition of the electrical connector, portion 41 comes to lie in a cavity 11 of the electrical connector present between base 1 and contact support 3, and thus renders possible that the location of the contact element, and more strictly speaking the location of the plug modules containing the same may still vary and/or be changed to a certain extent with respect to the proper normal position also in the assembled state of the plug, both in the longitudinal direction of the contact elements 4 and in the direction transverse to said longitudinal direction. This turns out to be advantageous both in terms of manufacture of the electrical connector and in terms of use thereof.

The bulges 42 (or comparable designs of the contact elements) constitute resilient contact locations via which the contact elements 4 of the plug are contacted with the contact elements of the coupling member. If, as in the embodiment shown, there are provided several contact location establishing bulges or the like on each contact element, the respective contact elements may be contacted at multiple locations with the contact elements to be contacted, and thus are multiple contact elements permitting particularly good and reliable connections to be established with other contact elements.

The contact elements 4 are each arranged so as to extend along the surface of the contact supports 3 carrying them and are, held in the proper position on the respective contact support 3 by having plastics material injection-molded around part thereof.

In case of the plug, the contact supports 3 are constituted by rails provided with groove-like recesses 31 at those locations where the contact elements 4 are supposed to come to lie, i.e. on mutually opposing longitudinal sides.

In assembling the contact elements 4 on the contact supports 3, the contact elements 4 are inserted into the groove-like recesses 31 and then are fixed to the respective contact support by injection-molding around the rear end of the contact support 3 and the contact element parts located there.

The contact elements 4 then are mounted to the contact support 3 such that the front end thereof terminates a distance before the front end of contact support 3 and that the rear end thereof, inclusive of the bent or kinked portion 41, projects beyond the rear end of contact support 3.

In the embodiment shown, the portions without injection-molding of the parts of the contact elements arranged in the groove-like recesses 31 of contact support 3 are not attached to the contact support 3. However, the contact elements are designed and injection-molded to the contact supports such that the non-molded portions thereof extending through the groove-like recesses 31 are resiliently urged against the bottom of the recess 31 through which they extend. It is ensured in this manner that the contact elements—although these are each attached to the contact supports at one single location only—cannot or, at any rate, cannot easily leave the groove-like recesses.

By way of the design and assembly of the contact elements as described hereinbefore, these can be reliably held in their proper position even if they are of very small and/or weak design and/or if they were subjected to mechanical loads.

Due to the afore-mentioned injection molding operation around contact support 3, the latter is provided with a collar 32 at the rear end thereof. This collar, as will still be described in more detail, can be utilized for mounting the contact supports (the plug modules containing the contact supports) within the plug. By way of the afore-described connection of contact support and contact elements, the plug module thus does not become larger than without such a connection.

As regards the contact support 3, it is to be noted furthermore that the same is tapered at the front end thereof (where no contact elements are provided). This serves for centering the mutually associated plug and coupling modules during mating of plug and coupling member.

A contact support 3 and the contact elements arranged thereon as just described constitute a plug module SM of the type shown in FIG. 1.

A plurality of the plug modules SM that can be configured and made as described hereinbefore can be combined with the afore-mentioned base 1 and the afore-mentioned housing 2 so as to form a plug of the type according to FIG. 2.

In the embodiment shown, the base 1 is a plate-like member designed at the top thereof for placement of a plurality of plug modules SM and of the housing 2, and designed at the bottom thereof for soldering the rear ends of the contact elements 4 to the base 1 and for mounting the base 1 on a circuit board, not shown in the drawings.

The base 1 is formed in its bottom with a multiplicity of holes provided for passage of the rear ends of the contact elements 4. The top side of the base bottom is provided in addition with the recesses which, in the assembled state of the plug, constitute the already mentioned cavities 11. In assembling the plug modules SM on the base 1, the rear ends of the contact elements 4 are passed through the holes in the base bottom and are soldered or otherwise electrically and/or mechanically connected to the base on the bottom side thereof or to elements provided for connecting the base to the circuit board. The bent or kinked portions 41 of the contact elements 4 come to lie in the recesses of base 1 that constitute the cavities 11 of the plug.

In the embodiment illustrated, the housing 2 is a trough-like structure having a bottom 21 and side walls 22. Bottom 21 is provided with openings through which the forward parts of the plug modules SM can be passed.

The rear ends of the plug modules SM, which carry the collars 32, cannot pass the openings in the housing bottom.

In the assembled state of the plug, the plug module parts not fitting through the housing bottom openings come to lie between the housing 2 and the base 1, as shown in exemplary manner in FIG. 4A. Housing 2 is connected to base 1, for example, by an adhesive bond, a locking-type connection or other connection. Thus, base 1, housing 2 and plug modules SM thus are combined to form an integral unit.

In the assembled state of the plug, as described, the side walls 22 of housing 2 extend around the portion of the plug containing the plug modules. These walls project beyond the front ends of the plug modules.

The front end of the housing side walls 22 is provided with a taper 23 on the inside thereof. This taper serves for centering plug housing and coupling member housing when plug and coupling member are mated.

In the embodiment illustrated, the coupling member for connection to the plug designed and made as described hereinbefore, is of different construction and manufactured differently than the plug.

As can be seen in particular from FIG. 4B, the coupling member comprises a base 6, a housing 7 and a plurality of coupling modules KM, with each coupling module KM consisting of a contact support 8 and a multiplicity of contact elements 9.

In the embodiment illustrated, there is provided for each coupling module KM one single contact support 8 each; each thereof has mounted thereon all contact elements 9 of the respective coupling modules. However, the invention is not restricted to this design. Basically, it is possible for each coupling module KM to have an arbitrary number of contact supports 8.

As can be seen in particular from FIGS. 1 and 3, the contact elements 9 are arranged on their supporting contact support 8 in two mutually opposing contact element rows. Although this is presently deemed to be the optimum arrangement, the invention is not restricted thereto.

In so far, there is conformity with the plug according to FIG. 4A. The individual components of the coupling member, however, are different from the corresponding components of the plug.

In the embodiment illustrated, the contact elements 9, just like the contact elements 4 of the plug, are constituted by relatively long and relatively narrow metal strips with as high rigidity as possible. In a portion 91 located relatively far to the rear, they have a (preferably multiply) curved or kinked path (e.g. of zig-zag shape), but are otherwise of straight design.

The bent or kinked portion 91 of the contact elements 9 renders possible that the parts of the contact elements 9 located on either side thereof are movable relative to each other. In the properly assembled condition of the electrical connector, portion 91 comes to lie in a cavity 61 of the electrical connector present between base 6 and contact support 8, and thus renders possible that the location of the contact elements 9, and more strictly speaking the location of the coupling modules containing the same may still vary and/or be changed to a certain extent with respect to the proper normal position also in the mated state of the coupling member, both in the longitudinal direction of the contact elements and in the direction transverse to said longitudinal direction. This turns out to be advantageous both in terms of manufacture of the electrical connector and in terms of use thereof.

The contact elements 9 are each arranged so as to extend along the surface of the contact supports 8 carrying the same. In this case, however, the contact support 8 is injection-molded to the contact elements which prior thereto were properly arranged and aligned (and inserted in an injection-molding means). Injection-molding of the contact support 8 to the contact elements 9 means for the contact elements 9 a partial injection-molding of plastics material around the same. Due to this molding operation, the contact elements are attached to the contact support 8 formed by such injection-molding, with such attachment being effected over the entire length of the contact element portions extending along the contact support 8.

In the embodiment illustrated, the contact supports 8 are constituted by sleeves of rectangular cross-section which on two confronting insides are provided with a row of contact elements 9 each and at the rear end thereof have a collar 82 extending around the contact support 8.

The contact elements 9 are arranged on the contact support 8 such that the front end thereof terminates a distance before the front end of the contact support 8 and that the rear end thereof, inclusive of the bent or kinked portion 81 projects beyond the rear end of the contact support 8.

The part of the contact elements extending along the surface of contact support 8, in the embodiment illustrated, is connected to the contact support 8 along the entire length thereof. The contact elements 9 thus can be reliably held in their proper position, even if they are of very small and/or weak design and even if they were subjected to mechanical loads.

A contact support 8 and the contact elements 9 arranged thereon as just described constitute a coupling module KM of the type shown in FIG. 1.

The contact support 8 is tapered on the inside edge on its front end (where no contact elements are provided). This serves for centering the mutually associated plug and coupling modules when plug and coupling member are mated.

A plurality of the coupling modules KM that can be configured and made as described hereinbefore can be combined with the afore-mentioned base 6 and the afore-mentioned housing 7 so as to form a coupling member of the type according to FIG. 3.

In the example shown, the base 6 is a plate-like member designed at the top thereof for placement of a plurality of coupling modules KM and of the housing 2, and designed at the bottom thereof for soldering the rear ends of the contact elements 9 to the base 6 and for mounting the base 6 on a circuit board, not shown in the drawings. The base 6 is formed in its bottom with a multiplicity of holes provided for passage of the rear ends of the contact elements 9. The top side of the base bottom is provided in addition with the recesses which, in the assembled state of the coupling member, constitute the already mentioned cavities 61. In assembling the coupling modules KM on the base 6, the rear ends of the contact elements 9 are passed through the holes in the base bottom and are soldered or otherwise electrically and/or mechanically connected to the base on the bottom side thereof or to elements provided for connecting the base to the circuit board. The bent or kinked portions 91 of the contact elements 9 thus come to lie in the recesses of the base that constitute the cavities 61 of the coupling member.

In the embodiment illustrated, the housing 7 is a profiled member of rectangular cross-section that is open at the top and at the bottom and has an inner portion subdivided by intermediate walls 72 extending parallel to the outer walls 71. By way of the outer and intermediate walls 71 and 72, a multiplicity of channels is defined that are arranged side by side and on top of each other, with each channel being adapted to receive a coupling module. The outer and intermediate walls 71, 72 of housing 7 extend around each individual coupling module when the coupling modules are in the state attached to the base and the housing.

The outer and intermediate 71 and 72 have projections 711 and 721 which project into the channels and, in the assembled state of the coupling member, come to lie shortly above the collars 82 of the coupling modules KM; the collars 82 of the coupling modules, in the assembled state of the coupling member, come to lie between base 6 and housing 7, as shown in exemplary manner in FIG. 4B.

The housing 7 is connected to the base 6, for example, by an adhesive bond, a locking-type connection or other connection. Base 6, housing 7 and coupling modules KM thus are combined to form an integral unit.

In the assembled state of the coupling member, as described, the walls 71 and 72 of housing 7 extend around each individual one of the coupling modules of the coupling member. The housing parts (walls 71, 72) enclosing the coupling modules project beyond the front ends of the coupling modules.

The front end of outer walls 71 of housing 7 are provided with a taper 712 on the outsides thereof. This taper serves to center plug housing and coupling housing when plug and coupling member are being mated.

Upon mating of plug and coupling member, the front ends of housings 2 and 7 meet first, since at least one of the housings, but preferably both housings, extend beyond the front ends of plug and/or coupling modules. Due to the tapers 23 and 712 provided at the front ends of the housings, the housings are centered relative to each other and may thus easily be slid onto each other. In the embodiment illustrated, the plug housing is slid over the coupling housing. When the housings 2 and 7 meet, the plug modules and the coupling modules still are a distance apart from each other. Sliding of the housings 2 and 7 onto each other thus may effect pre-centering of the same—without any forces acting on the plug modules and the coupling modules.

While the plug housing is being slid onto the coupling housing, the associated plug and coupling modules sooner or later meet. As these are tapered on their front ends as well and since, moreover, they are already pre-centered, they can be inserted into each other substantially without any mechanical loads being exerted thereon.

In the embodiment illustrated, this is enhanced further by the fact that the plug modules and/or the coupling modules are movable relative to each other and/or relative to the respective housings and/or bases.

With regard to the plug modules, this movability is achieved in that

- the plug modules are attached to the plug "only" in that a predetermined part of the plug modules (the collar 32 in the embodiment illustrated) is held more or less loosely between base 1 and housing 2 (between collar 32 and the parts of base 1 and housing 2 surrounding the same, there are provided spaces permitting movements of the respective plug module to a certain extent in the assembled state of the plug as well), and
- the contact elements 4 have a bent or kinked portion (portion 41) which comes to lie in a cavity (cavity 11) provided between base 1 and housing 2 and thus to a certain extent permits relative movements of the contact element parts located on either side of portion 41 in the assembled state of the plug as well.

The plug modules thus can at least slightly move relative to each other and/or relative to the other plug components.

With respect to the coupling modules that are movable in this manner as well, the movability is achieved in that

- the coupling modules are attached to the coupling member "only" in that a predetermined part of the coupling modules (the collar 82 in the embodiment illustrated) is held more or less loosely between base 61 and housing 72 (between collar 82 and the parts of base 6 and housing 7 surrounding the same, there are provided spaces permitting movements of the respective coupling module to a certain extent in the assembled state of the plug as well), and
- the contact elements 9 have a bent or kinked portion (portion 91) which comes to lie in a cavity (cavity 61) provided between base 6 and housing 7 and thus to a certain extent permits relative movements of the contact element parts located on either side of portion 91 in the assembled state of the coupling member as well.

The coupling modules thus can at least slightly move relative to each other and/or relative to the other coupling member components.

Due to the mutually independent floating arrangement of the plug modules SM within the plug and the mutually in dependent floating arrangement of the coupling modules KM in the coupling member, the plug modules and the coupling modules can align optimally with respect to each other in all situations, whereby they can at all times be properly mated automatically and without or at any rate without significant mechanical loads being exerted on the modules and the connectors containing the same.

This holds even if the components of the plugs and coupling members are not manufactured and/or assembled exactly according to specifications and/or if their positions and/or their dimensions vary (e.g. due to slight damages or temperature fluctuations).

In mating plug and coupling member, each plug contact element 4 establishes contact with the associated coupling member contact element 9 at multiple locations. It is thus possible to establish electrical connections of highest quality.

The coupling member contact elements 9, during mating with the plug contact elements 4, come to lie in the groove-like recesses 31 of the plug modules; the webs of the contact support 3 of the plug, which are present between adjacent groove-like recesses 31, in the mated state of plug and coupling member, extend up to the contact supports 8 of the coupling member and thus separate (isolate) adjacent contact element pairs from each other. Adjacent contact elements of the plug and coupling modules thus cannot interfere with each other. In particular, no flow of leakage currents is possible.

Plugs and coupling members with constructions as described can be mated and unmated substantially without a risk of damage and, in doing so, permit excellent electrical connections to be established in all situations. The connections are of low impedance, withstand high voltages and large currents and are relatively insensitive to fluctuating or adverse effects from the surroundings, such as extreme and/or fluctuating temperatures, vibrations, moisture, dirt etc.

The properties mentioned are obtained irrespective of the size and contact density of the electrical connectors designed and manufactured as described hereinbefore.

The electrical connectors described thus can be made very small and/or with high contact density with in essence the same excellent properties.

This was confirmed by tests: to this end, the electrical connectors shown in FIGS. 2 and 8, i.e. electrical connectors each with 8 connector modules and in total 256 contacts were realized on a space of 24.9 mm×5.4 mm×9 mm (length×width×depth in the mated state).

The handling properties of the electrical connectors and the quality of the electrical connections that can be produced by them turned out to be excellent.

Some technical data:

Range of operating temperatures:

−30 to +125° C.

Current-carrying capacity per contact:

250 mA at 25° C.

150 mA at 85° C.

Breakdown strength of adjacent contacts:

650 V with dc current

750 V with ac current

Volume resistivity:

175 mΩ

Contact resistance:

40 mΩ

$4\times10^{10}$ Ω

These are results that cannot even approximately be achieved using known multi-position miniature connectors.

For connecting the electrical connectors to the circuit board carrying them, it is to be pointed out that the electrical connectors, to be more precise the bases thereof, can be mounted on circuit boards using, for example, the so-called BGA (ball grid array) or PSGA (plastic stud grid array) technology.

With regard to BGA technology, it is to be pointed out that the balls may be arranged directly at the locations where the contact element parts passed through the base reach the bottom side of the base, or may be arranged more or less remote therefrom.

Figure 5:
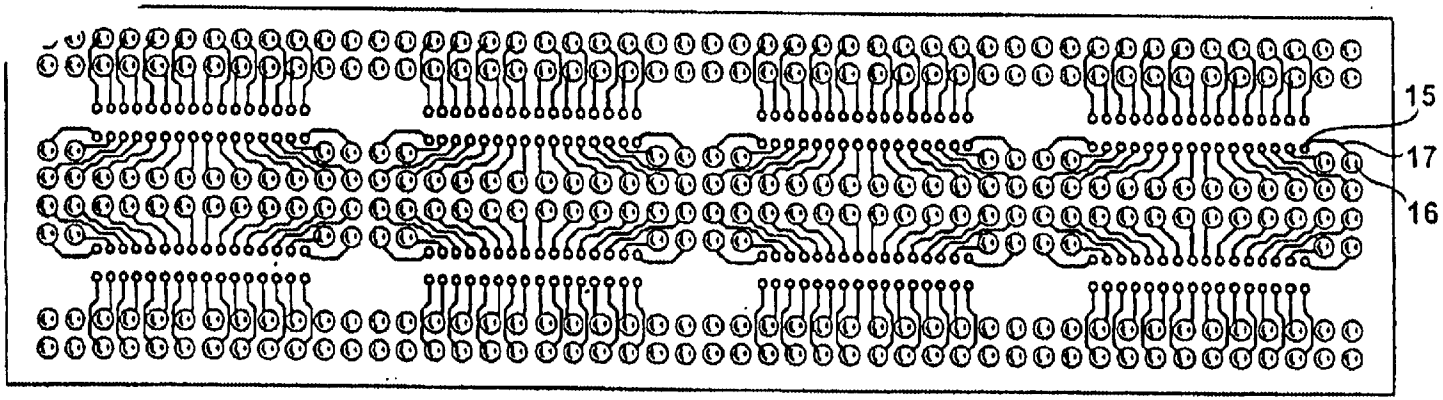
FIG. 5 shows a bottom plan view of a base of the plug according to FIG. 2 or of the coupling member according to FIG. 3, said base being mountable on a circuit board by way of the BGA technology.

In the latter case, i.e. if the balls are arranged more or less remote from the locations where the contact element parts passed through the base reach the bottom side of the base, the contact elements or the locations where these reach the bottom side of the base, respectively, and the balls must be electrically connected to each other via conductive tracks or in a different manner. This is illustrated in FIG. 5 in exemplary manner. The locations where the contact elements reach the bottom side of the base are designated 15, the balls are designated 16 and the conductive tracks connecting the locations to the balls 16 are designated 17.

Figure 6:
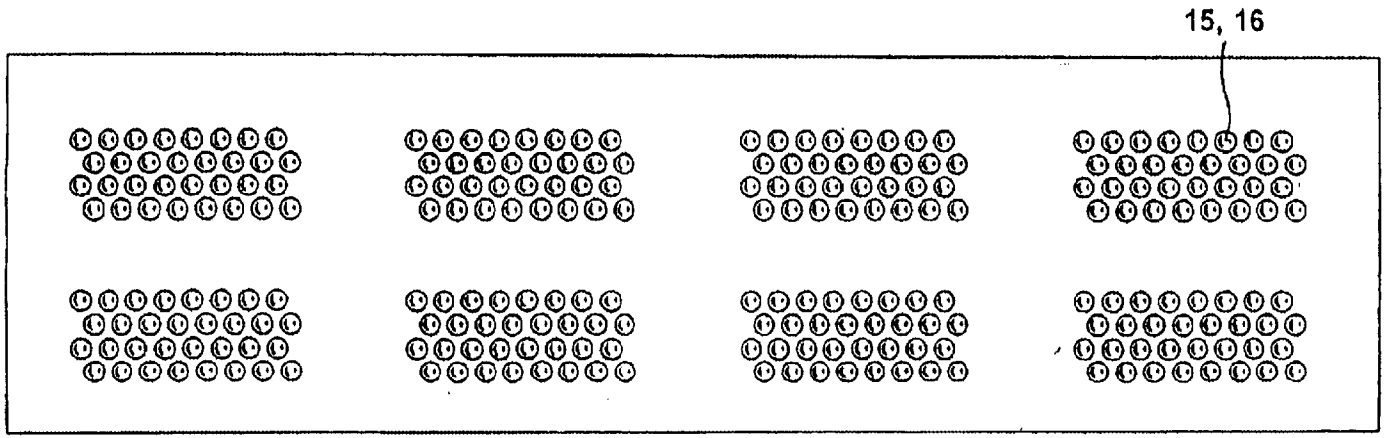
FIG. 6 shows a bottom plan view of a modified base of the plug according to FIG. 2 or of the coupling member according to FIG. 3.

If the balls are arranged directly at the locations where the contact elements reach the bottom side of the base, these locations are preferably positioned such that they (and the balls to be applied thereto) are spaced apart by certain minimum distances. The locations where the contact elements reach the base bottom side then are no longer arranged in two opposing rows, as in case of the contact elements on the contact supports, but are arranged, for example, in two opposing double rows each consisting of two individual rows arranged in mutually offset manner (in the embodiment illustrated, by half of the distance between adjacent elements of the row). Such an arrangement is shown in FIG. 6. The locations where the contact elements reach the base bottom side are again designated 15, and the balls are again designated 16. The balls 16 lie on the locations 15 so that, contrary to the base according to FIG. 5, there are no longer required conductive tracks for connecting the same.

Due to the measures mentioned, it is possible in both cases, i.e. both if the balls are arranged directly at the locations where the contact element parts passed through the base reach the base bottom side, and if the balls are more or less remote from these locations, to ensure in all situations (in particular irrespective of the contact element density of the respective connector modules) that the balls are spaced apart from each other to the extent necessary for practical application of the BGA technology.

Irrespective of this, plugs and coupling members of the type described hereinbefore may also be realized with leading or trailing contacts, double contacts and power contacts.

Electrical connectors having a construction as described may be designed as multi-position miniature connectors by means of which electrical connections of high quality can be established in reliable manner.

What is claimed is:

1. An electrical connector comprising one or more connector modules, each said connector module comprising at least one contact support having groove-like recesses at those locations where contact elements are to be provided thereon, and a multiplicity of contact elements connected to the contact support and extending along the surface thereof, the contact elements being connected to the contact supports by having plastics material injection-molded around part thereof, wherein the contact supports and the contact elements being supported by the same are connected to each other in non-releasable manner, and wherein the contact elements are inserted into the groove-like recesses of the contact supports and, at the rear end of the contact supports, are connected to the contact support.

2. An electrical connector according to claim 1, wherein the contact elements are constituted by metal strips.

3. An electrical connector according to claim 1, wherein the front ends of the contact supports are portions thereof without contact elements.

4. An electrical connector according to claim 3, wherein the front ends of the contact supports are provided with tapers suitable for centering with respect to other contact elements.

5. An electrical connector according to claim 1, wherein the contact elements project beyond the rear end of the contact supports.

6. An electrical connector according to claim 5, wherein the contact elements have a bent or kinked section in the portion thereof extending beyond the rear end of the contact supports.

7. An electrical connector comprising one or more connector modules, each said connector module comprising at least one contact support and a multiplicity of contact elements connected to the contact support and extending along the surface thereof, the contact elements projecting beyond the rear end of the contact supports, and the contact elements have a bent or kinked section in the portion thereof extending beyond the rear end of the contact supports, wherein the contact element parts located on either side of the bent or kinked sections are movable relative to each other also in the assembled state of the electrical connector, wherein the contact supports and the contact elements being supported by the same are connected to each other in non-releasable manner, and wherein the bent or kinked sections of the contact elements in the assembled state of the electrical connector, come to lie in a cavity contained in said connector.

8. An electrical connector according to claim 7, wherein the contact elements, in the region in which they are supposed to establish contact with an associated contact element, have one or more protuberances or bulges acting as contact locations.

9. An electrical connector according to claim 8, wherein the portions of the contact elements having said protuberances or bulges are designed to be resilient.

10. An electrical connector according to claim 7, wherein the contact elements are connected to the contact supports by having plastics material injection-molded around part thereof.

11. An electrical connector according to claim 7, wherein the contact supports have groove-like recesses at those locations where contact elements are to be provided thereon.

12. An electrical connector according to claim 11, wherein the contact elements are inserted into the groove-like recesses of the contact supports and, at the rear end of the contact supports, are connected to the contact support.

13. An electrical connector according to claim 12, wherein the contact elements are designed and mounted to the contact supports such that the parts thereof extending through the groove-like recesses, which are not injection-molded to the contact supports, are resiliently urged against the bottom of the groove-like recess through which they extend.

14. An electrical connector according to claim 13, wherein the contact support is injection-molded to the contact elements.

15. An electrical connector according to claim 7, wherein the assembled state of the electrical connector, a predetermined section of the connector modules is inserted between other components of the electrical connector and thereby is held there.

16. An electrical connector according to claim 15, wherein said predetermined section of the connector modules and the other components of the electrical connector receiving said section therebetween have spaces provided therebetween.

17. An electrical connector comprising one or more connector modules, each said connector module comprising at least one contact support and a multiplicity of contact elements connected to the contact support and extending along the surface thereof, wherein the contact supports and the contact elements being supported by the same are connected to each other in non-releasable manner, and wherein the connector modules, in the assembled state of the electrical connector, are movable relative to each other and/or relative to other components of the electrical connector, and wherein the connector modules are individually or commonly enclosed on the sides thereof by parts of a housing.

18. An electrical connector according to claim 17, wherein the housing parts enclosing the connector modules project beyond the front end of the connector modules.

19. An electrical connector comprising one or more connector modules, each said connector module comprising at least one contact support and a multiplicity of contact elements connected to the contact support and extending along the surface thereof, wherein the contact supports and the contact elements being supported by the same are connected to each other in non-releasable manner, and wherein said connector is designed to be soldered to a circuit board using the BGA technology, and wherein the balls are arranged remote from the locations where the contact elements reach the section of the electrical connector to be soldered to the circuit board, and that the respective locations and the associated balls are connected to each other via conductive tracks.

20. An electrical connector according to claim 19, wherein the balls are arranged at the locations where the contact elements reach the section of the electrical connector to be soldered to the circuit board, and in that the arrangement of the respective locations is selected to be different from the arrangement of the contact elements on the contact supports.

* * * * *